US005986412A

United States Patent [19]

Collins

[11] Patent Number: 5,986,412

[45] Date of Patent: Nov. 16, 1999

[54] SINGLE BALLAST FOR POWERING PLURAL HIGH INTENSITY DISCHARGE LAMPS

[75] Inventor: Byron R. Collins, Tuxedo, N.C.

[73] Assignee: General Electric Company, Schenectady, N.Y.

[21] Appl. No.: 08/861,923

[22] Filed: May 22, 1997

Related U.S. Application Data

[60] Provisional application No. 60/030,695, Nov. 13, 1996.

[51] Int. Cl.[6] ..... H05B 41/16

[52] U.S. Cl. ..... 315/291; 315/208; 315/247; 315/289; 315/323

[58] Field of Search ..... 315/209 CD, 290, 315/289, 307, 323, 291, 208, 297, DIG. 5, 308, 247, 151

[56] References Cited

U.S. PATENT DOCUMENTS

| | | | |
|---|---|---|---|
| 4,006,384 | 2/1977 | Elms et al. | 315/323 |
| 4,145,638 | 3/1979 | Kaneda | 315/323 |
| 5,017,840 | 5/1991 | Droho | 315/291 |
| 5,608,296 | 3/1997 | Brown | 315/289 |

OTHER PUBLICATIONS

"Gemini: A Tandem Ballast Metal Halide Lighting System by GE Lighting Systems," General Electric Company, brochure OLP–2588D, Aug. 1996, two pages.

"Wiring Diagram No. 35–406685R2," General Electric Company, 1995, one page.

"Wiring Diagram No. 35–406257R3," General Electric Company, 1995, one page.

*Primary Examiner*—Don Wong
*Assistant Examiner*—Wilson Lee
*Attorney, Agent, or Firm*—Charles E. Bruzga, Esq.

[57] ABSTRACT

A ballast circuit for a plurality of serially connected, high pressure gas discharge lamps comprises an electromagnetic ballast arrangement receptive of an input power signal, providing an output ballast voltage for driving the plurality of lamps, and providing an open circuit ballast voltage when the lamps are disconnected from the arrangement. A first ignitor circuit is connected between the ballast arrangement and the first lamp, and produces at least one ignitor pulse of high voltage and high frequency compared to the open circuit ballast voltage, to initiate starting of the first lamp. A second ignitor circuit is connected between the first lamp and a second lamp so as to be supplied with current through the first lamp. The second circuit produces at least one ignitor pulse of high voltage and high frequency compared to the open circuit ballast voltage after the first lamp begins to start and drops substantially in impedance, to initiate starting of the second lamp.

10 Claims, 1 Drawing Sheet

SINGLE BALLAST FOR POWERING PLURAL HIGH INTENSITY DISCHARGE LAMPS

This application claims priority from provisional application Ser. No. 60/030,695, filed on Nov. 13, 1996.

FIELD OF THE INVENTION

The present invention relates to ballast circuits for powering high pressure gas discharge lamps, and more particularly to a single ballast circuit for powering plural high pressure gas discharge lamps connected in series.

BACKGROUND OF THE INVENTION

A high pressure discharge lamp, such as a metal halide, mercury or high pressure sodium lamp, is typically powered by an electromagnetic ballast circuit incorporating an iron core. The ballast transformer receives voltage from a power source, and outputs a ballast voltage for driving the lamp. The ballast circuit, which uses the iron core to achieve the necessary voltage adjustment, represents a major component of ballast cost, as well as bulk. The foregoing type of ballast circuit typically suffers the problem of powering only a single high pressure lamp. It would be desirable to more efficiently utilize a ballast circuit so that it simultaneously powers plural (e.g. dual) high pressure gas discharge lamps and realizes a considerably reduced per-lamp ballast cost and improved ballast efficiency.

SUMMARY OF THE INVENTION

The invention overcomes the foregoing problem in an exemplary embodiment comprising a ballast circuit for a plurality of serially connected, high pressure gas discharge lamps. The circuit comprises an electromagnetic ballast arrangement receptive of an input power signal, providing an output ballast voltage for driving the plurality of lamps, and providing an open circuit ballast voltage when the lamps are disconnected from the arrangement. A first ignitor circuit is connected between the ballast arrangement and the first lamp, and produces at least one ignitor pulse of high voltage and high frequency compared to the open circuit ballast voltage, to initiate starting of the first lamp. A second ignitor circuit is connected between the first lamp and a second lamp so as to be supplied with current through the first lamp. The second circuit produces at least one ignitor pulse of high voltage and high frequency compared to the open circuit ballast voltage after the first lamp begins to start and drops substantially in impedance, to initiate starting of the second lamp.

DETAILED DESCRIPTION OF THE INVENTION

Figure 1:
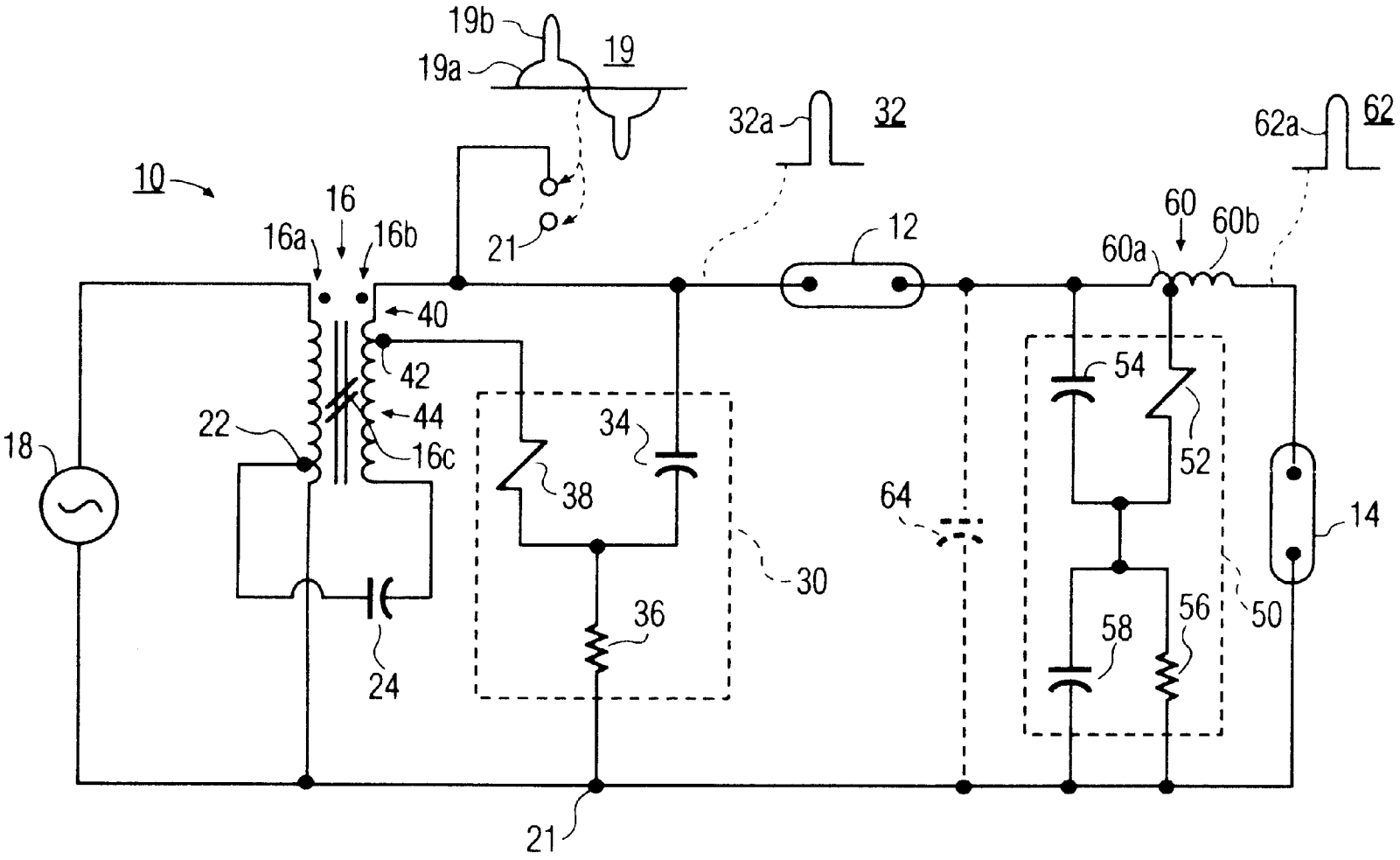
FIG. 1 is a schematic diagram of a single ballast circuit for powering a plurality of high pressure gas discharge lamps, in accordance with the invention.

FIG. 1 shows a ballast circuit 10 for powering high pressure discharge lamps 12 and 14, which are connected in series. Circuit 10 is a constant-wattage autotransformer circuit. A primary winding 16*a* of an electromagnetic (e-m) component 16 receives an a.c. power signal from a source 18, and produces, as an output, a ballast voltage 19 on secondary winding 16*b* with respect to a reference node 21, for driving lamps 12 and 14. E-m component 16 is known as a regulating transformer; its secondary winding 16*b* is tapped into primary winding 16*a* at 22, and its primary and secondary windings 16*a* and 16*b* are shunted as indicated by diagonal lines 16*c*. A ballast capacitor 24 produces a desired phase angle between current and voltage supplied by source 18, and, in combination with e-m component 16, limits current to lamps 12 and 14.

The specific type of e-m component used, however, is not critical to the invention; any other e-m component providing a suitable ballast voltage 19 for driving lamps 12 and 14 may be used, such as a reactor or lag ballast.

For starting lamp 12, ballast circuit 10 includes an ignitor pulse circuit 30 for producing one or more ignitor pulses 32. Of particular interest is the high frequency content of the rapidly rising, leading edge of pulse 32 with respect to ballast voltage 19. Such high frequency content is referred to herein as a high frequency and high voltage ignitor pulse 32*a*, although such pulse may comprise only the higher frequency part of the overall pulse 32.

Although pulse 32*a* is shown as positive, on the next negative excursion of ballast voltage 19, pulse 32*a* would be negative. The particular form of ignitor pulse circuit 30 shown is merely exemplary; many other configurations will be apparent to those of ordinary skill in the art based on this specification.

Circuit 30 includes a capacitor 34, which becomes charged from ballast voltage 19 via a resistor 36. The voltage across capacitor 34 is impressed across the series combination of a voltage-breakover (VBO) device 38 and a number of turns 40 of secondary winding 16*b*, via tap 42. During lamp starting, the voltage on capacitor 34 continues to rise until the similarly increasing voltage across VBO device 38 reaches the breakover voltage rating of such device. Device 38 then rapidly breaks over (i.e., becomes conductive), causing the voltage across capacitor 34 to be impressed directly across secondary winding turns 40. This induces a voltage across the remaining secondary winding turns 42, which adds to the voltage across winding turns 40 and the voltage on ballast capacitor 24, to create ignitor pulse 32*a* that is high relative to ballast voltage 19. With respect to the specific example of implementing FIG. 1 set forth below, pulse 32*a* is typically 2,500 volts with respect to reference node 21 or higher as required by the lamp specification.

Other forms of ignitor pulse circuit 30 may include a two-terminal starting aid, as is conventionally known per se. Such a starting aid incorporates its own transformer for creating a pulse of current, rather than tapping into secondary winding 16*b* at 42, as shown.

For starting lamp 14, a second ignitor pulse circuit 50 is preferably arranged so to be supplied with current substantially entirely through lamp 12. Circuit 50 includes a VBO device 52. A capacitor 54 is coupled across device 52, and becomes charged by current flow through a resistor 56 and, preferably, also though a capacitor 58. A pulse transformer 60 includes a primary winding 60*a* coupled to device 52, and a secondary winding coupled to lamp 14.

When capacitor 54 becomes charged sufficiently that device 52 fires, the rapid voltage change across primary winding 60*a* results in an ignitor pulse 62 across winding 60*b*, which is coupled to lamp 14. As with pulse 32, the leading edge 62*a* of pulse 62 comprises the higher frequency part of pulse 62 and is referred to herein as an ignitor pulse 62*a*. To assist coupling of ignitor pulse 62*a* to the lamp, a capacitance 64 shown in phantom may be employed. At the high frequency of the ignitor pulse, capacitance 64 appears as a low impedance across which a low voltage drop occurs.

Capacitance 64 thus forces most of the ignitor pulse to appear across the lamp, to facilitate its starting. Capacitance 64 may comprise inherent capacitance of the conductors supplying lamps 12 and 14, or it may comprise a discrete capacitor.

As shown in FIG. 1, ballast transformer 16 preferably provides a ballast voltage 19 having a component 19*a* comprising a fundamental component, and a peak component substantially higher in frequency and magnitude than the fundamental component. The frequency of peak component 19*b* is especially high on its upwardly rising slope from the fundamental component. Periodic negative-voltage excursions of ballast voltage 19 are typically symmetrical to its positive-voltage excursions.

Preferably, capacitor 58 of ignitor circuit 50 cooperates with capacitor 54 to provide a capacitive voltage-divider network for coupling ballast voltage 19 to VBO device 52. In particular, the network impresses peak component 19*b* of the ballast voltage across VBO device 52 during the time when the peak component is nearing its peak value. This causes the VBO device to fire and generate an ignitor pulse applied to second lamp 14. Beneficially, the second lamp receives the ignitor pulse when the ballast voltage is near its maximum value, facilitating starting of the lamp.

In the process of starting lamps 12 and 14, lamp 12 will begin to start first. Typically, it will enter into a so-called glow mode, in which its impedance substantially drops in value. This allows the necessary current for creating an adequate ignitor pulse for starting the second lamp to be supplied through the first lamp 12.

In a specific example of implementing the ballast circuit of FIG. 1, the following component values may be used for a pair of 135-volt, 400-watt metal halide lamps, wherein polarities of transformer windings are indicated by dots in FIG. 1, and ballast transformer 16 is a regulating ballast providing 3.2 amps lamp current:

| | |
|---|---|
| Ballast capacitor 24 | 20 microfarads |
| Source voltage 18 | 277 volts r.m.s. |
| Number of turns 40 of secondary winding 16a | 28 |
| Number of turns 44 of secondary winding 16b | 391 |
| Starting capacitor 34 | 0.16 microfarads |
| Resistor 36 | 20.0 k ohms |
| Capacitance 64 | 200 picofarads |
| Capacitor 54 | 0.22 microfarads |
| Capacitor 58 | 0.01 microfarads |
| Resistor 56 | 6 k ohms |
| Number of turns of primary winding 60a | 3 |
| Number of turns of secondary winding 60b | 45 |

Voltage-breakover device 38 may comprise one or more serially connected SIDACs having a total breakover voltage of 225 volts, such as available under Part No. KIV24 from Shidengen Electric Mfg. Co. Ltd. of Tokyo, Japan. Voltage-breakover device 52 may comprise one or more serially connected SIDACs having a total breakover voltage of 225 volts, such as available under Part No. KIV24 from Shidengen Electric Mfg. Co. Ltd. of Tokyo, Japan.

High pressure discharge lamps other than metal halide lamps as described in the above example for implementing FIG. 1 can be used. In order to most reliably benefit from the present invention, however, a high pressure gas discharge lamp should have a reasonably constant operating voltage over its lifetime. Because the same current flows through all serially connected lamps, the respective wattages of the lamps are strongly dependent on their respective operating voltages. Essentially, such operating voltages should not vary so greatly over the lifetime of the lamps that the respective wattages of the lamps vary into undesired (e.g. outside-of-rated) ranges. It is most preferred that such lamp operating voltage be maintained to within about 15–20 percent of a nominal value, although, depending on ballast capacity, more variation can be tolerated.

Within the foregoing, general constraint of lamp-operating voltage being reasonably constant, a series of lamps powered in accordance with the invention can be of mixed variety, e.g. a metal halide lamp connected to a mercury lamp. By way of example, limited-dose sodium lamps also typically have a reasonably constant operating voltage.

The principles of the present invention extend to the sequential starting of more than just the two lamps as described above. This is accomplished simply by iterating, for instance, the second ignitor circuit and the second lamp as a third ignitor circuit and a third lamp (not shown) serially connected to the second lamp. In such case, the third lamp would start after the second lamp enters a glow mode and drops substantially in impedance to allow sufficient current to start the third lamp.

While the invention has been described with respect to specific embodiments by way of illustration, many modifications and changes will occur to those skilled in the art. It is, therefore, to be understood that the appended claims are intended to cover all such modifications and changes as fall within the true scope and spirit of the invention.

What is claimed is:

1. A ballast circuit for a plurality of serially connected, high pressure gas discharge lamps without heated filaments, comprising:

(a) an electromagnetic ballast arrangement receptive of an input power signal, providing an output ballast voltage for driving said plurality of lamps which are without heated filaments, and providing an open circuit ballast voltage when said lamps are disconnected from said arrangement;

(b) a first ignitor circuit connected between said ballast arrangement and a first lamp, and producing at least one ignitor pulse of high voltage and high frequency compared to said open circuit ballast voltage, to initiate starting of said first lamp; and (c) a second ignitor circuit connected between said first lamp and a second lamp so as to be supplied with current through said first lamp; said circuit producing at least one ignitor pulse of high voltage and high frequency compared to said open circuit ballast voltage after said first lamp begins to start and drops substantially in impedance, to initiate starting of said second lamp.

2. The ballast circuit of claim 1, wherein said second ignitor circuit comprises:

(a) a voltage-breakover device;

(b) a capacitor coupled to said device in such manner that the voltage of said capacitor increases with current supplied through said first lamp to a point at which said device fires; and (c) a pulse transformer having an input winding coupled across said device and an output winding coupled across said second lamp for applying an ignitor pulse thereto.

3. A ballast circuit for a plurality of serially connected, high pressure gas discharge lamps, comprising:

(a) an electromagnetic ballast arrangement receptive of an input power signal, providing an output ballast voltage for driving said plurality of lamps, and providing an open circuit ballast voltage when said lamps are disconnected from said arrangement;

(b) a first ignitor circuit connected between said ballast arrangement and a first lamp, and producing at least one ignitor pulse of high voltage and high frequency compared to said open circuit ballast voltage, to initiate starting of said first lamp; and (c) a second ignitor circuit connected between said first lamp and a second lamp so as to be supplied with current through said first lamp; said circuit producing at least one ignitor pulse of high voltage and high frequency compared to said open circuit ballast voltage after said first lamp begins to start and drops substantially in impedance, to initiate starting of said second lamp; said second ignitor circuit comprising:

(i) a voltage-breakover device;

(ii) a capacitor coupled to said device in such manner that the voltage of said capacitor increases with current supplied through said first lamp to a point at which said device fires; and (iii) a pulse transformer having an input winding coupled across said device and an output winding coupled across said second lamp for applying an ignitor pulse thereto;

(d) said ballast arrangement supplying a ballast voltage having a fundamental component and a peak component substantially higher in voltage than said fundamental component; and (e) said second ignitor circuit including a capacitive voltage-divider network receptive of said ballast voltage and arranged to impress part of said peak component across said device to cause it to fire while said peak component is present in said ballast voltage.

4. The ballast circuit of claim 1, wherein each of said high pressure gas discharge lamps comprises one of a metal halide lamp, a mercury lamp, and a limited dose sodium lamp.

5. A ballast circuit for a plurality of serially connected, high pressure gas discharge lamps without heated filaments, comprising:

(a) an electromagnetic ballast arrangement receptive of an input power signal, providing an output ballast voltage for driving said plurality of lamps which are without heated filaments, and providing an open circuit ballast voltage when said lamps are disconnected from said arrangement;

(b) a first ignitor circuit connected between said ballast transformer arrangement and a first lamp, and producing at least one ignitor pulse of high voltage and high frequency compared to said open circuit ballast voltage, to initiate starting of said first lamp; and (c) a second ignitor circuit connected between said first lamp and a second lamp so as to be supplied with current substantially entirely through said first lamp; said circuit producing at least one ignitor pulse of high voltage and high frequency compared to said open circuit ballast voltage after said first lamp begins to start and drops substantially in impedance, to initiate starting of said second lamp.

6. The ballast circuit of claim 5, wherein said second ignitor circuit comprises:

(a) a voltage-breakover device;

(b) a capacitor coupled to said device in such manner that the voltage of said capacitor increases with current supplied through said first lamp to a point at which said device fires; and (c) a pulse transformer having an input winding coupled across said device and an output winding coupled across said second lamp for applying an ignitor pulse thereto.

7. The ballast circuit of claim 6, wherein:

(a) said ballast transformer arrangement supplies a ballast voltage having a fundamental component and a peak component substantially higher voltage than said fundamental component; and (b) said second ignitor circuit includes a capacitive voltage-divider network receptive of said ballast voltage and arranged to impress part of said peak component across said device to cause it to fire while said peak component is present in said ballast voltage.

8. The ballast circuit of claim 6, wherein each of said high pressure gas discharge lamps comprises one of a metal halide lamp, a mercury lamp, and a limited dose sodium lamp.

9. The ballast circuit of claim 1, wherein said ballast circuit lacks a capacitor shunting said first lamp.

10. The ballast circuit of claim 5, wherein said ballast circuit lacks a capacitor shunting said first lamp.

* * * * *